US006865913B2

(12) United States Patent
Yamagishi

(10) Patent No.: US 6,865,913 B2
(45) Date of Patent: Mar. 15, 2005

(54) LOCKING APPARATUS

(75) Inventor: Junichi Yamagishi, c/o Unirec Co., Ltd., 6-3, 2-chome, Kaminarimon, Taito-ku, Tokyo (JP), 111-0034

(73) Assignees: Unirec Co., Ltd., Tokyo (JP); Junichi Yamagishi, Tokyo (JP)

( * ) Notice: Subject to any disclaimer, the term of this patent is extended or adjusted under 35 U.S.C. 154(b) by 0 days.

(21) Appl. No.: 10/636,141

(22) Filed: Aug. 6, 2003

(65) Prior Publication Data

US 2004/0025550 A1 Feb. 12, 2004

(30) Foreign Application Priority Data

Aug. 9, 2002 (JP) ..... 2002-234178

(51) Int. Cl.[7] ..... E05B 13/10
(52) U.S. Cl. ..... 70/224; 70/278.1
(58) Field of Search ..... 70/224, 216, 278.1

(56) References Cited

U.S. PATENT DOCUMENTS 4,503,422 A * 3/1985 Hsu ..... 340/543
4,967,305 A * 10/1990 Murrer et al. ..... 361/172
5,083,122 A * 1/1992 Clark ..... 340/5.22
5,245,329 A * 9/1993 Gokcebay ..... 340/5.33
6,038,895 A * 3/2000 Menke et al. ..... 70/278.1
6,259,352 B1 * 7/2001 Yulkowski et al. ..... 340/5.7
6,347,486 B1 * 2/2002 Badillet ..... 49/394
6,374,652 B1 * 4/2002 Hwang ..... 70/277

FOREIGN PATENT DOCUMENTS

JP 2002-070382 3/2002

* cited by examiner

*Primary Examiner*—John B. Walsh
(74) *Attorney, Agent, or Firm*—Jordan and Hamburg LLP

(57) ABSTRACT

A locking apparatus has a lock driver to electrically lock and unlock a door, a fingerprint read/verify unit to receive a fingerprint from a user, verify the received fingerprint by comparing it with registered fingerprint data) and if the fingerprint verification authenticates the user, enable the lock driver to electrically operate, a key cylinder attached to the door, an interlink linking the key cylinder with the lock driver, and a key to manually operate the lock driver in cooperation with the key cylinder and the interlink.

4 Claims, 6 Drawing Sheets

LOCKING APPARATUS

BACKGROUND OF THE INVENTION

1. Field of the Invention

The present invention relates to a locking apparatus capable of locking and unlocking a door with a mechanical operation using a key and an electrical operation using biometric information such as a fingerprint.

2. Description of Related Art

An example of a locking apparatus is disclosed in Japanese Unexamined Patent Application Publication No. 2002-70382. FIG. 8 is a front view partly showing the exterior side of a door 103 on which the locking apparatus of the disclosure is installed.

The locking apparatus includes an electronic lock 101 and a cylinder lock 102. The locks 101 and 102 are independent of each other and separately lock and unlock the door 103. The lock 101 has a housing 105 fixed to the door 103. The housing 105 has a chamber 109 that is opened and closed with a lid 107 and contains a fingerprint reader. The lock 101 receives electric power from a battery or a DC source.

A person who wants to open the door 103 opens the lid 107 and sets a finger on the fingerprint reader. The fingerprint reader reads a fingerprint from the finger, and a fingerprint verifier verifies the read fingerprint by comparing it with registered fingerprint data. If the fingerprint verification authenticates the person, the door 103 is electrically unlocked.

The cylinder lock 102 has a key cylinder 111 fixed to the door 103. A key is inserted into the key cylinder 111 to mechanically lock or unlock the door 103.

In this way, the related art provides the door 103 with the electronic lock 101 and cylinder lock 102. Usually, the electronic lock 101 is used because it easily locks and unlocks the door 103. If the user intends not to use the electronic lock 101, or if power supply is cut, or if the fingerprint reader or fingerprint verifier breaks, the cylinder lock 102 can be used to lock and unlock the door 103. The user can optionally choose the cylinder lock 102 that uses a key to lock and unlock the door 103 or the electronic lock 101 that uses no key to do the same.

The related art has a problem that the door 103 will not be unlocked with the electronic key 101 if the door 103 is locked with the cylinder lock 102 and if the key for the cylinder lock 102 is lost thereafter.

The related art has another problem that it involves many parts and needs time and labor to install it on the door 103 because it employs the two separate lock mechanisms, i.e., the electronic lock 101 and cylinder lock 102.

SUMMARY OF THE INVENTION

An object of the present invention is to provide a locking apparatus involving a small number of parts, easy to install on a door, and capable of locking and unlocking the door even if a key is lost.

In order to accomplish the object, the present invention provides a locking apparatus having a lock driver configured to electrically lock and unlock a door, a biometric verifier configured to receive biometric information from a person, verify the received biometric information by comparing it with registered biometric information, and if the biometric verification authenticates the person, enable the lock driver to electrically operate, a key cylinder attached to the door, an interlock configured to interlock the key cylinder with the lock driver, and a key configured to manually operate the lock driver in cooperation with the key cylinder and interlock.

With the locking apparatus of the first aspect, a second aspect of the present invention employs a lever configured to open and close the door, a pivot shaft extended from the lever to face the lock driver, and a hollow formed through the pivot shaft, configured to receive the key cylinder. The interlock extends from the key cylinder. An end of the interlock engages with the lock driver when the lever with the key cylinder incorporated in the hollow is installed on the door.

With the locking apparatus of any one of the first and second aspects, a third aspect of the present invention employs a detector configured to detect a manipulation on the key cylinder, and an alarm configured to give an alarm if the detector detects a manipulation on the key cylinder.

With the locking apparatus of the third aspect, a fourth aspect of the present invention employs an alarm power supply circuit configured to supply power to the alarm, a detector switch configured to form the detector, the detector switch and alarm being connected to the alarm power supply circuit, and a normally-closed disconnecting switch arranged in the alarm power supply circuit, configured to disconnect the alarm power supply circuit when the biometric verifier authenticates the person.

With the locking apparatus of the fourth aspect, a fifth aspect of the present invention connects the biometric verifier to the alarm power supply circuit.

According to the first aspect, a person who wants to lock or unlock the door enters his or her biometric information into the biometric verifier. The biometric verifier verifies the entered biometric information by comparing it with registered biometric information, and if the biometric verification authenticates the person, enables the lock driver to electrically lock or unlock the door. Alternatively, the person can insert the key into the key cylinder, and with the key, mechanically manipulate the lock driver through the interlock, to lock or unlock the door.

The user can optionally choose whether to lock and unlock the door with the key or without the key. Even if the key is lost, the door can be locked and unlocked with the use of the lock driver and biometric verifier.

According to the first aspect, the interlock interlocks the key cylinder with the lock driver, so that the door can manually be locked and unlocked by inserting the key into the key cylinder and by turning the key to operate the lock driver through the key cylinder and interlock. The first aspect employs only one lock mechanism, and therefore, has a reduced number of parts and a simple structure and realizes easy installation on a door.

In addition to the effects of the first aspect, the second aspect employs the lever to open and close the door, the pivot shaft extended from the lever to face the lock driver, and the hollow formed through the pivot shaft, to receive the key cylinder. The interlock is extended from the key cylinder. An end of the interlock engages with the lock driver when the lever with the hollow thereof incorporating the key cylinder is installed on the door. Only by incorporating the key cylinder in the hollow and by fixing the lever to the door, the lock driver that basically electrically operates becomes manually operable. The second aspect, therefore, realizes easy installation of the locking apparatus on a door.

In addition to the effects of the first and second aspects, the third aspect employs the detector to detect a manipulation on the key cylinder, and the alarm to give an alarm if the detector detects a manipulation on the key cylinder. If the third person tries to illegally unlock the door by manipulating the key cylinder by, for example, a so-called picking technique, the third aspect warns the third person by giving an alarm, thereby preventing the illegal unlocking of the door by the third person.

In addition to the effects of the third aspect, the fourth aspect employs the alarm power supply circuit configured to supply power to the alarm, the detector switch configured to form the detector, the detector switch and alarm being connected to the alarm power supply circuit, and the normally-closed disconnecting switch arranged in the alarm power supply circuit, configured to disconnect the alarm power supply circuit when the biometric verifier authenticates the person who entered his or her biometric information.

When the alarm gives an alarm, the person whose biometric information is registered in the locking apparatus can immediately stop the alarm through biometric verification. The fourth aspect can issue an alarm to prevent the third person from illegally unlocking the door, and at the same time, can allow an authenticated person to stop the alarm and unlock the door.

In addition to the effects of the fourth aspect, the fifth aspect connects the biometric verifier to the alarm power supply circuit, so that, when the detector switch is turned on, the alarm power supply circuit may supply power to the biometric verifier. Even if the lock driver electrically fails, the biometric verifier can receive power from the alarm power supply circuit and conduct biometric verification to stop or not to start an alarm.

DETAILED DESCRIPTION OF EMBODIMENTS

Locking apparatuses according to embodiments of the present invention will be explained with reference to the accompanying drawings.

First Embodiment

Figure 1:
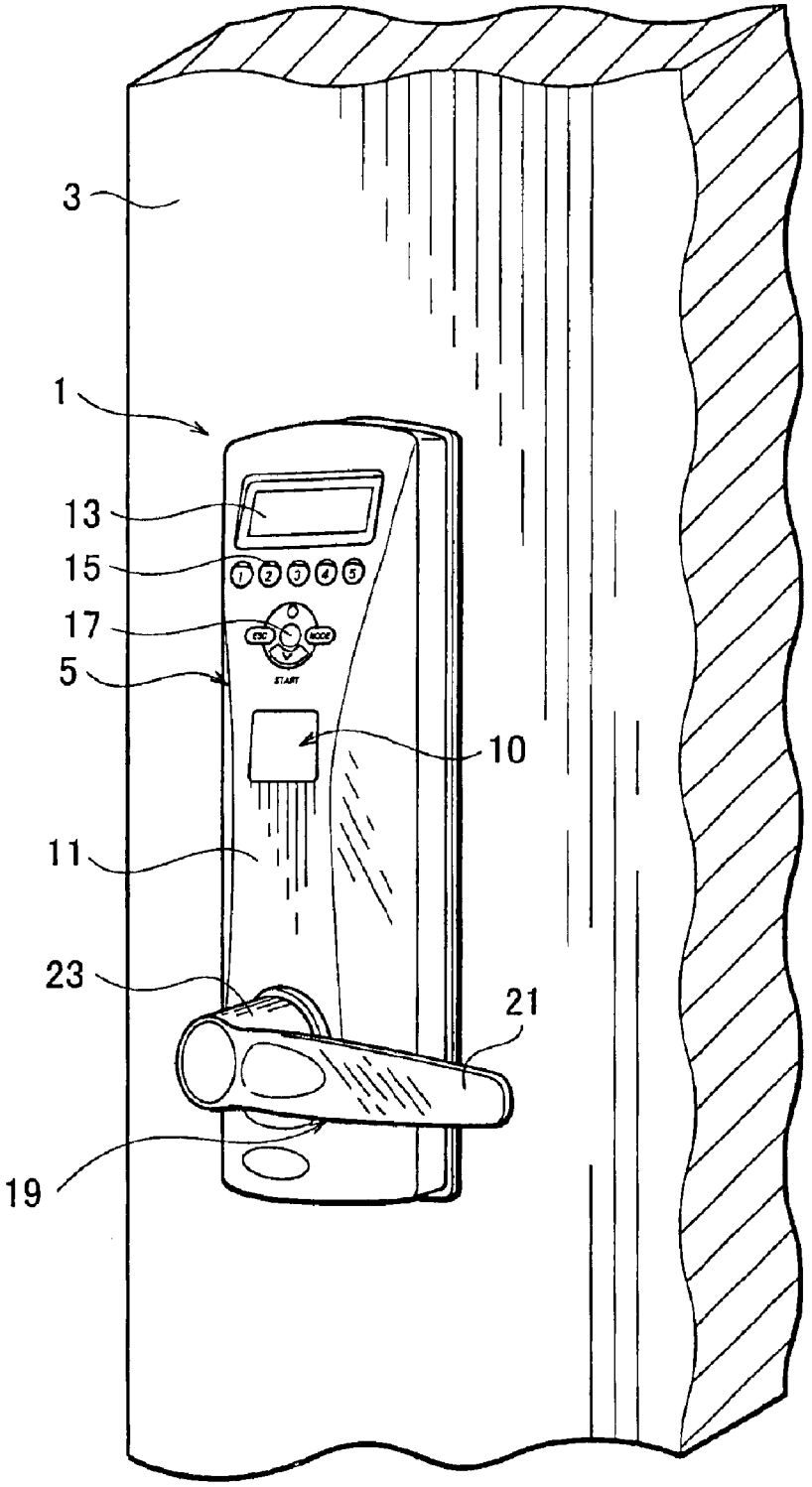
FIG. 1 is a perspective view partly showing a door with a locking apparatus according to a first embodiment of the present invention.
Figure 2:
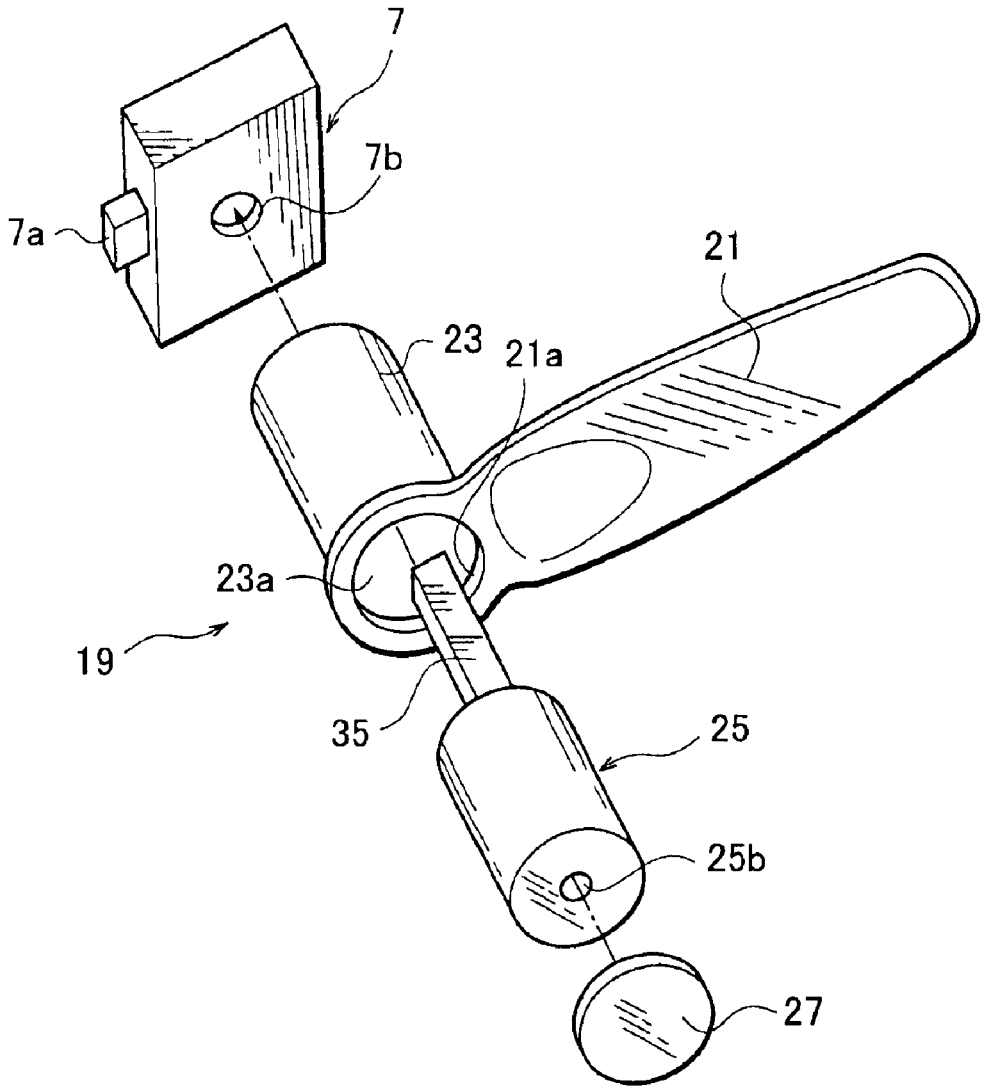
FIG. 2 is an exploded view showing the locking apparatus of FIG. 1.
Figure 3A:
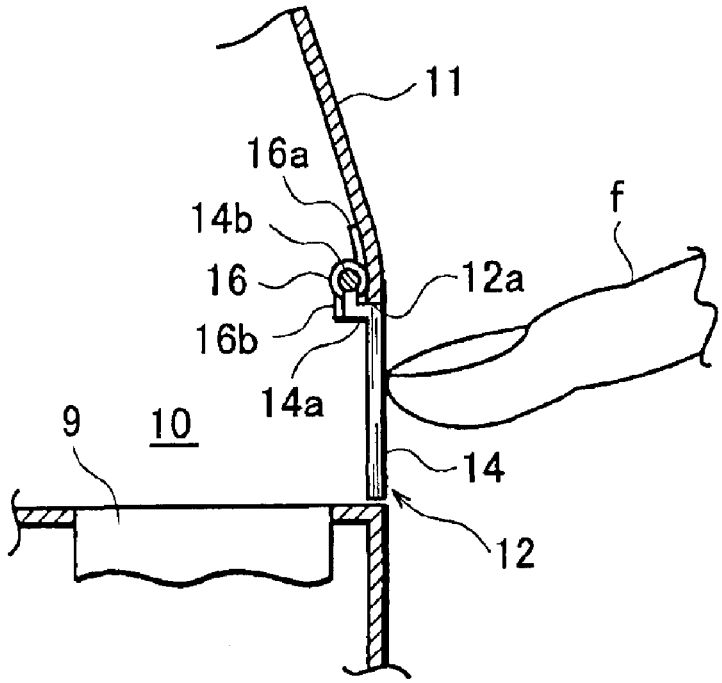
FIGS. 3A and 3B are sectional views showing a fingerprint verifier of the locking apparatus of FIG. 1 before and after inserting a finger into the verifier.
Figure 3B:
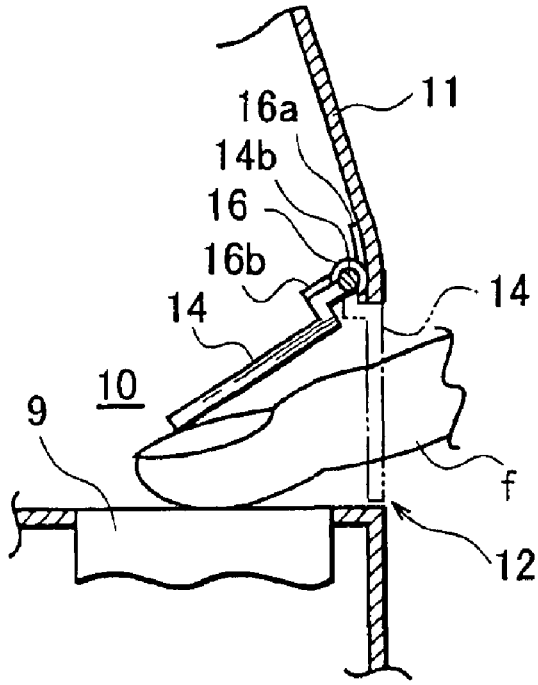

FIG. 1 is a perspective view partly showing a door with a locking apparatus according to the first embodiment of the present invention, FIG. 2 is an exploded view showing the locking apparatus of FIG. 1, and FIGS. 3A and 3B are sectional views showing a fingerprint verifier of the locking apparatus of FIG. 1 before and after inserting a finger into the verifier.

The locking apparatus 1 according to the first embodiment allows a user to optionally choose a usual locking/unlocking operation using a key or an easy locking/unlocking operation using no key. The locking apparatus 1 has an exterior unit 5 attached to the exterior side of a door 3. Inside the door 3, the locking apparatus 1 has a lock driver 7 to lock and unlock the door 3. The locking apparatus 1 also has a fingerprint read/verify unit 9 forming a part of a biometric verifier 10. When a person wants to lock or unlock the door 3, the person puts a finger on the read/verify unit 9. Then, the read/verify unit 9 reads biometric information, i.e., a fingerprint from the finger, verifies the read fingerprint by comparing it with registered fingerprint data, and authenticates or rejects the person who entered the fingerprint. If the person is authenticated, the read/verify unit 9 outputs an authenticated signal to electrically operate the lock driver 7 to lock or unlock the door 3.

The locking apparatus 1 also has a key cylinder 25 attached to the door 3 and a rod 35 serving as an interlock to interlock the key cylinder 25 with the lock driver 7. The rod 35 allows a user to insert a key 31 into the key cylinder 25 and manually operate the lock driver 7 to lock or unlock the door 3.

According to the first embodiment, biometric information handled by the read/verify unit 9 is a fingerprint. The present invention is not limited to this. The biometric information may be the iris, vein patterns on the back of a hand, and the like, and the read/verify unit 9 may be so configured to handle the biometric information.

In FIG. 1, the exterior unit 5 has a housing 11 fixed to the door 3. The housing 11 has the biometric verifier 10 incorporating the read/verify unit 9, a lever 19 for opening and closing the door 3, an LCD panel 13 for displaying various functions, registration buttons 15 for entering, for example, an identification number, and set buttons 17 for setting various conditions.

In FIGS. 3A and 3B, the biometric verifier 10 in the housing 11 has a chamber 12. The chamber 12 has an opening 12*a* formed through the housing 11. The opening 12*a* is used when inserting a finger into the chamber 12. At the bottom of the chamber 12, the fingerprint read/verify unit 9 is installed. The read/verify unit 9 is oriented to cross a direction (left-right direction in FIGS. 3A and 3B) in which a finger f is inserted into and removed from the chamber 12.

The opening 12*a* of the chamber 12 is provided with a lid 14 to open and close the chamber 12. The opening 12*a* and lid 14 are each quadrate in a front view. When moved to a closed position, the lid 14 just fits in the opening 12*a*.

The lid 14 has a top end 14*a* formed in, for example, a hook shape. The top end 14*a* has an integral shaft 14*b* that is rotatably supported by the housing 11. Around the shaft 14*b*, *a* torque spring 16 is wound. The torque spring 16 has an arm 16*a* engaged with the housing 11 and an arm 11*b* engaged with the lid 14. The torque spring 16 serving as a pusher to push the lid 14 toward the closed position where the lid 14 closes the opening 12*a*. The pusher to push the lid 14 toward the closed position is not limited to the torque spring 16. It may be any optional means.

At the closed position, the top end 14*a* of the lid 14 is stopped by a top end of the opening 12*a*.

The lid 14 is made of conductive material such as metal, plastic mixed with carbon fiber, or conductive plastic.

The lid 14 is interlocked with a switch 20 of a power supply circuit for the locking apparatus 1, to turn on and off the power supply circuit in response to the opening and closing of the lid 14. The lid 14 is grounded.

Figure 4:
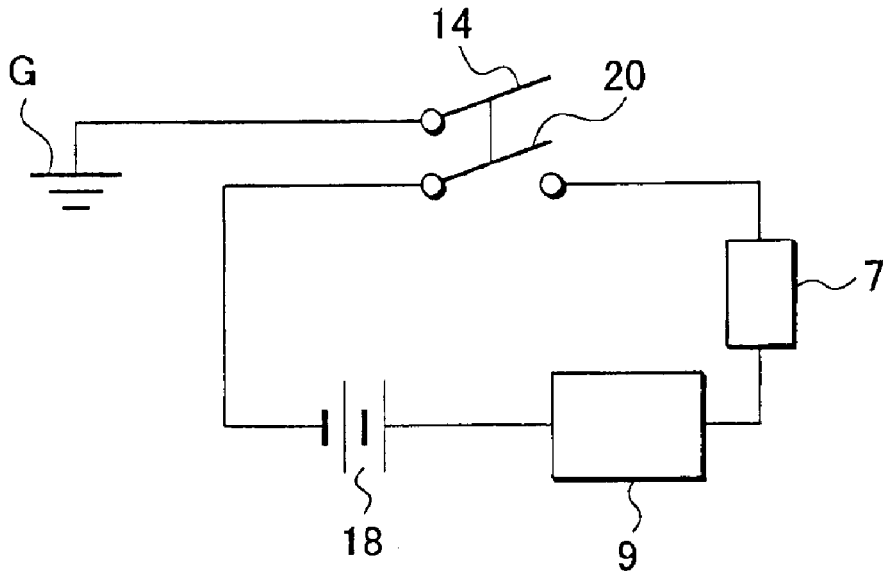
FIG. 4 is a circuit diagram showing a power supply circuit for the locking apparatus of FIG. 1.

FIG. 4 is a circuit diagram showing an example of the power supply circuit for the locking apparatus 1. The power supply circuit has a power source such as a battery 18 or a DC source. In the power supply circuit, the battery 18, read/verify unit 9, lock driver 7, and switch 20 are connected in series. The switch 20 is used to turn on and off the power supply circuit.

In operation of the locking apparatus 1, a person inserts a finger f into the chamber 12 through the opening 12*a*. The lid 14 turns around the shaft 14*b* as shown in FIG. 3B against the force of the torque spring 16. Interlocked with this movement of the lid 14, the switch 20 is closed to supply power from the battery 18 to the read/verify unit 9, lock driver 7, and the like.

The key cylinder 25 and related parts are assembled as shown in FIGS. 1 and 2. The lever 19 has an elongated handle 21 provided with a pivot shaft 23 on the back of the handle 21. The pivot shaft 23 is an elongated cylindrical fitting rotatably attached to the housing 11. When the lever 19 is turned with the handle 21, an interlocked latch (not shown) is released to open the door 3.

The handle 21 of the lever 19 has an opening 21*a* that is continuous to a hollow 23*a* formed through the pivot shaft 23. The opening 21*a* and hollow 23*a* form a space to accommodate the key cylinder 25. A cover 27 is removably attached to the opening 21*a* after the key cylinder 25 is set in the hollow 23*a*, to cover an end face of the key cylinder 25. The cover 27 has substantially the same shape as the opening 21*a* and is made to provide substantially the same material feeling and color as the handle 21. When fitted into the opening 21*a*, the surface of the cover 27 becomes substantially flush with the surface of the handle 21.

The key cylinder 25 has an elongated cylindrical shape that is substantially the same as the shape of the hollow 23*a* in the pivot shaft 23. The key cylinder 25 is inserted into the hollow 23*a* from the opening 21*a* of the handle 21. The key cylinder 25 is supported by the housing 11 or the door 3 at, for example, a front end of the pivot shaft 23.

Figure 5:
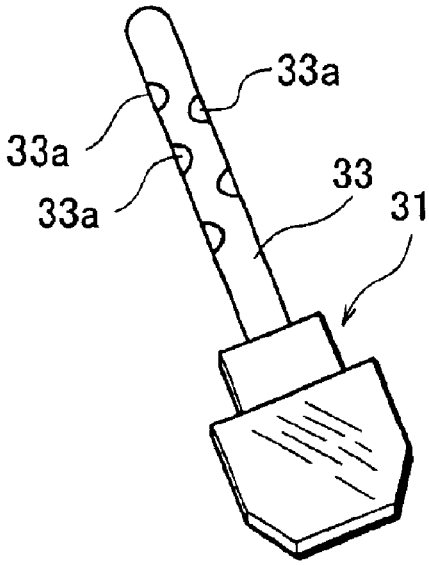
FIG. 5 is a perspective view showing a key for a key cylinder shown in FIG. 2.

In FIG. 2, the key cylinder 25 has an opening 25*b* at the center of an end face that faces the opening 21*a* of the lever 19. The opening 25*b* has a simple shape, for example, a circular shape and forms a keyhole in the key cylinder 25. The key 31 of FIG. 5 is inserted into the keyhole through the opening 25*b*.

According to the first embodiment, the key 31 has a cylindrical inserter 33 that has dents 33*a* on the peripheral face thereof. On the other hand, the keyhole of the key cylinder 25 has pins to engage with the dents 33*a* of the key 31. When the key 31 is inserted into the opening 25*b* of the key cylinder 25 and the inserter 33 of the key 31 reaches the keyhole in the key cylinder 25, the pins in the keyhole engage with the dents 33*a* of the inserter 33. Under this state, the key 31 may be turned to turn the key cylinder 25.

In FIG. 2, the other end face of the key cylinder 25 opposite to the end face having the opening 25*b* is provided with the rod 35 serving as an interlink. The interlink 35 extends from the center of the end face of the key cylinder 25 in a longitudinal direction. The interlink 35 is long and a base end thereof is connected to the keyhole of the key cylinder 25, so that the interlink 35 may turn around its axis when the key inserted in the keyhole is turned. A front end of the interlink 35 is connected to the lock driver 7 to enable the user to manually and mechanically operate the lock driver 7.

On the back side of the lever 19, the lock driver 7 faces the pivot shaft 23 of the lever 19 and is on a line extended from the hollow 23*a* and opening 21*a* of the lever 19. The lock driver 7 incorporates a locking mechanism and a motor to drive the locking mechanism. The lock driver 7 has a bolt 7*a* that is protruded and retracted by the locking mechanism. The lock driver 7 can electrically be driven in response to an authenticated signal provided by the fingerprint read/verify unit 9. The authenticated signal drives the motor in the lock driver 7, to activate the locking mechanism in the lock driver 7 and protrude or retract the bolt 7*a*, thereby locking or unlocking the door 3.

The lock driver 7 has a circular opening 7*b* to receive the front end of the interlink 35 so that the front end of the interlink 35 may engage with the locking mechanism of the lock driver 7. This arrangement enables the mechanical and manual operation of the lock driver 7. When the user turns the key 31 in the key cylinder 25, the interlink 35 moves the locking mechanism of the lock driver 7 to protrude or retract the bolt 7*a* that locks or unlocks the door 3.

According to the first embodiment, a person who wants to lock or unlock the door 3 puts a finger on the fingerprint read/verify unit 9. The read/verify unit 9 reads a fingerprint from the finger, verifies the read fingerprint by comparing it with registered fingerprint data, and if the fingerprint verification authenticates the person, issues an authenticated signal. The authenticated signal drives the motor of the lock driver 7 to activate the locking mechanism in the lock driver 7 to lock or unlock the door 3.

According to the embodiment, the lock driver 7 is manually operable to lock or unlock the door 3. For manual operation of the locking apparatus 1, the user removes the cover 27 from the opening 21*a* of the lever 19 to expose the opening 25*b* of the key cylinder 25, inserts the key 31 into the opening 25*b*, and turns the key 31. Then, the interlink 35 interlocked with the key cylinder 25 drives the locking mechanism in the lock driver 7, to lock or unlock the door 3.

In this way, the locking apparatus 1 of the first embodiment is capable of electrically activating the lock driver 7 through the biometric (fingerprint) verification, as well as mechanically and manually activating the lock driver 7 with the use of the key 31, to lock and unlock the door 3. The user can choose any one of the usual locking/unlocking operation using the key 31 and the easy locking/unlocking operation not using the key 31. Even if the key 31 is lost, the user can electrically activate the lock driver 7 through the fingerprint verification, to lock or unlock the door 3.

According to the embodiment, the key cylinder 25 is connected to the lock driver 7 through the interlink 35, to allow the user to manually and mechanically operate the lock driver 7 with the key 31 inserted into the key cylinder 25. Compared with the locking apparatus of the related art that employs separate electronic lock and cylinder lock, the locking apparatus of the embodiment is simpler in structure and is easy to install on the door 3.

According to the embodiment, the opening 21*a* formed in the handle 21 of the lever 19 and the hollow 23*a* formed in the pivot shaft 23 of the lever 19 are configured to receive the key cylinder 25. The lock driver 7 faces the pivot shaft 23, and when the key cylinder 25 is set in the hollow 23*a* through the opening 21*a*, the lock driver 7 is engaged with the front end of the interlink 35 extending from the key cylinder 25. The key cylinder 25 incorporated in the hollow 23*a* can be supported by the housing 11, to manually operate the lock driver 7 with the key 31. The lock driver 7 is also operable electrically. The locking apparatus 1 according to the embodiment, therefore, is easy to install on a door.

According to the embodiment, the key cylinder 25 is accommodated in the hollow 23*a* of the pivot shaft 23 of the lever 19. This makes the locking apparatus 1 compact.

According to the embodiment, the key cylinder 25 set in the hollow 23*a* of the lever 19 is covered with the cover 27 fitted to the opening 21*a* of the lever 19. This may prevent the third person from illegally unlocking the door 3 and provide a good appearance. The cover 27 may always be removed, so that the key 31 and key cylinder 25 may always be used to lock and unlock the door 3.

According to the embodiment, the keyhole in the key cylinder 25 is positioned behind the opening 25*b*, and therefore, is unnoticeable by the third person. This surely prevents the third person from illegally unlocking the door 3.

Second Embodiment

Figure 6:
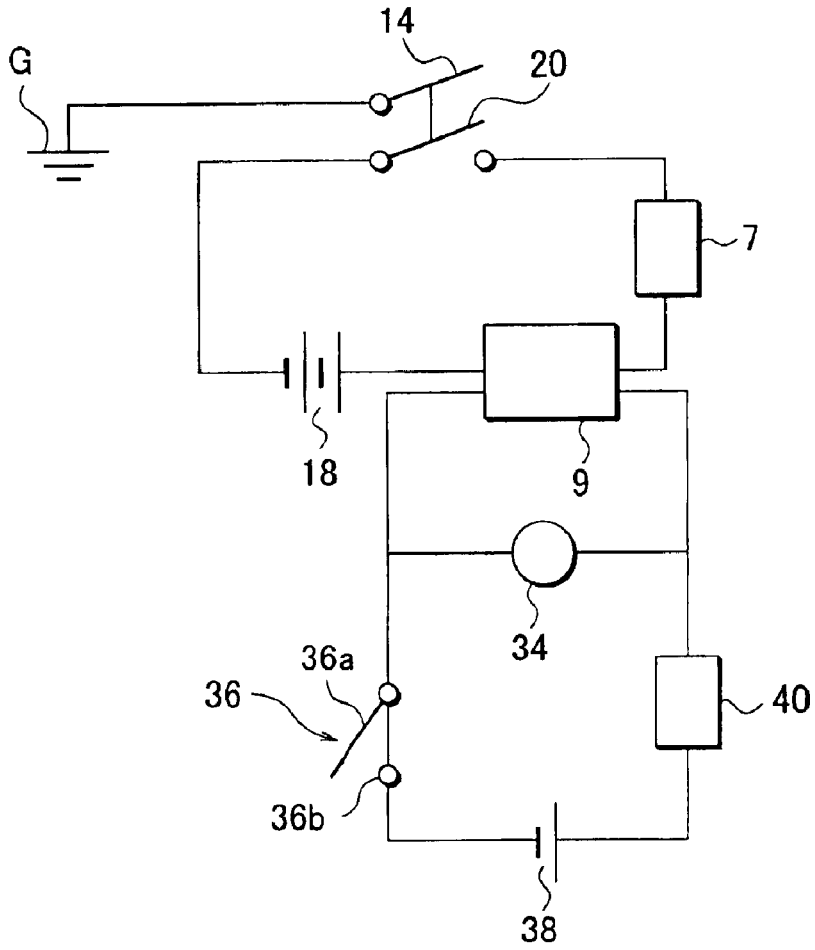
FIG. 6 is a circuit diagram showing a locking apparatus according to a second embodiment of the present invention.
Figure 7:
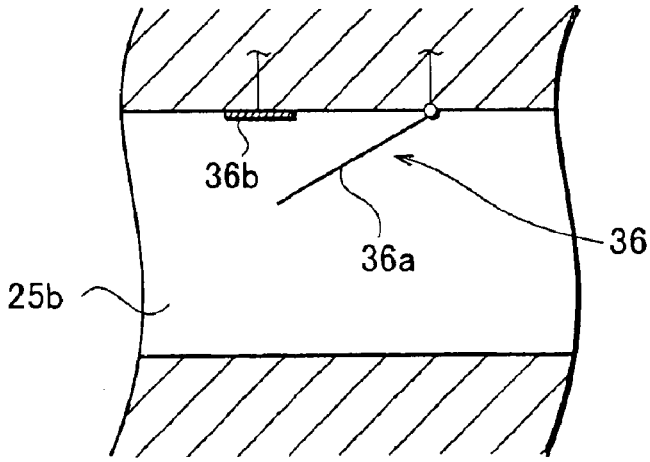
FIG. 7 is a sectional view partly showing a key cylinder of the locking apparatus of FIG. 6.
Figure 8:
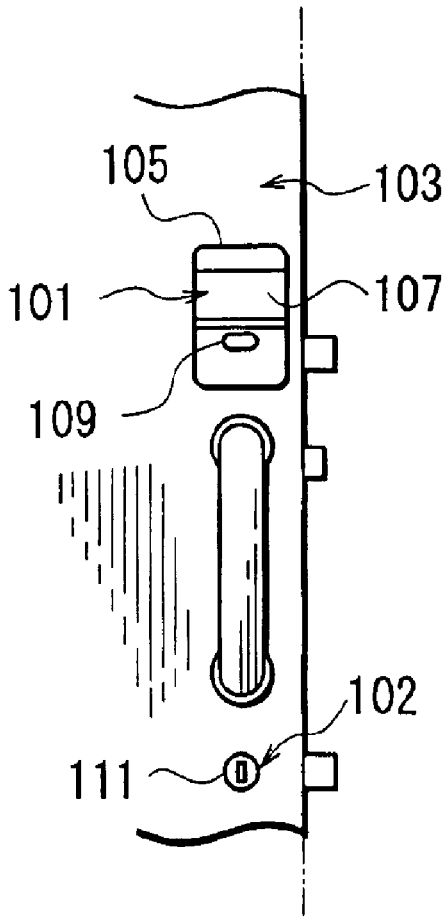
FIG. 8 is a front view partly showing a door with a locking apparatus according to a related art.

FIG. 6 is a circuit diagram showing a locking apparatus according to a second embodiment of the present invention, and FIG. 7 is a sectional view partly showing a key cylinder of the locking apparatus of FIG. 6. The second embodiment of FIGS. 6 and 7 is based on the first embodiment of FIGS. 1 to 5, and therefore, like parts are represented with like reference marks throughout the drawings, and the explanation of like parts will not be repeated.

The second embodiment employs a buzzer or an alarm 34 to give an alarm when the key 31 or a foreign object is inserted into the opening 25*b* of the key cylinder 25 to manually operate the lock driver 7. In FIG. 6, the second embodiment connects an alarm power supply circuit or a buzzer power supply circuit to the fingerprint read/verify unit 9 that is also connected to the power supply circuit of FIG. 4 of the first embodiment.

The buzzer power supply circuit includes the buzzer 34, a detector switch 36, an auxiliary battery 38 serving as a buzzer power source, and a relay 40 serving as a disconnecting switch. These elements are connected in series and are turned on and off with the detector switch 36. Between the detector switch 36 and the battery 38, the buzzer 34 is connected in parallel with the read/verify unit 9. According to the second embodiment, the buzzer power source 38, which may be a battery or a DC source, is independent of the battery 18 of the power supply circuit for the lock driver 7. The buzzer power source 38 may be omitted, and the battery 18 can supply power also to the buzzer power supply circuit.

When the detector switch 36 is closed, the battery 38 supplies power to the buzzer 34 and also to the read/verify unit 9. Namely, the read/verify unit 9 can receive power even if the power supply circuit of FIG. 4 fails due to some trouble.

The detector switch 36 is a normally-open switch having a movable contact 36*a* and a fixed contact 36*b*. When the movable contact 36*a* comes in contact with the fixed contact 36*b*, the switch 36 is closed, i.e., turned on. The switch 36 is arranged in the opening 25*b* of the key cylinder 25. A first end of the movable contact 36*a* is journaled to an inner circumferential face of the opening 25*b* and is slanted relative to a key inserting direction indicated with an arrow mark in FIG. 7. The movable contact 36*a* is always pushed by a pusher such as a torque spring (not shown) so that a second end of the movable contact 36*a* protrudes into the opening 25*b*. The movable contact 36*a* can turn around the first end thereof. The fixed contact 36*b* is fixed to the inner circumferential face of the opening 25*b*. When the key 31 or a foreign object is inserted into the opening 25*b*, the movable contact 36*a* comes in contact with the fixed contact 36*b*.

The relay 40 incorporates a usually-closed movable contact (not shown). This movable contact disconnects the relay 40 for a predetermined period in response to an authenticated signal that is generated by the fingerprint read/verify unit 9 on authentication of a person through the fingerprint verification mentioned in connection with the first embodiment. When the key 31 or a foreign object is inserted into the opening 25*b* to close the detector switch 36, the buzzer 34 gives an alarm, and if the fingerprint verification authenticates the person who inserted the key 31 or foreign object, the relay 40 is disconnected to stop the buzzer 34.

It is possible to arrange a timer that activates the buzzer 34 about, for example, five seconds after the closure of the detector switch 36 due to insertion of the key 31 or foreign object. In this case, the user whose fingerprint is registered can disconnect the relay 40 before activation of the buzzer 34.

In this way, the second embodiment allows the user who registered his or her fingerprint in the read/verify unit 9 to electrically lock and unlock the door 3 with the use of the read/verify unit 9 and lock driver 7.

If the lock driver 7 electrically breaks, the user can insert the key 31 into the key cylinder 25 to manually operate the lock driver 7 to lock or unlock the door 3.

When the key 31 is inserted into the opening 25*b* of the key cylinder 25, the key 31 pushes the second end of the movable contact 36*a* of the detector switch 36 toward the fixed contact 36*b*. This closes the detector switch 36 to supply power to the buzzer 34, which then gives an alarm. The read/verify unit 9 is connected to the buzzer power supply source, and therefore, the closed switch 36 supplies power from the buzzer power source 38 to activate the read/verify unit 9.

Then, the user whose fingerprint is registered in the read/verify unit 9 enters his or her fingerprint in the read/verify unit 9. Once the read/verify unit 9 authenticates the user through the fingerprint verification, the relay 40 is disconnected to stop the buzzer 34.

If the lock driver 7 electrically fails and if the main power source circuit (FIG. 4) is sound and can supply power to the read/verify unit 9, the user who registered his or her fingerprint in the read/verify unit 9 can finish the fingerprint verification with the read/verify unit 9 to disable the buzzer 34 before inserting the key 31 into the key cylinder 25.

With the disabled buzzer 34, the user inserts the key 31 into the cylinder 25 and manually operates the lock driver 7 to lock or unlock the door 3 without bothered by the buzzer 34.

In this way, the user who registered his or her fingerprint in the locking apparatus of the second embodiment can conduct the fingerprint verification to immediately stop the buzzer 34 that is giving an alarm or can prevent the activation of the buzzer 34 beforehand. With the silenced buzzer 34, the user can operate the key cylinder 25 and manipulate the lock drive 7 to lock or unlock the door 3.

If the third person tries to manipulate the key cylinder 25 and illegally unlock the door 3 with, for example, the picking technique, the detector switch 36 detects a foreign object inserted into the opening 25*b* of the key cylinder 25 and makes the buzzer 34 give an alarm. Warned with the buzzer 34, the third person may stop illegally unlocking the door 3.

In this way, the buzzer 34 prevents the illegal unlocking of the door 3 by the third person, and the biometric verifier 10 allows an authenticated person to stop the buzzer 34 and unlock the door 3.

According to the second embodiment, the fingerprint read/verify unit 9 is connected to the buzzer power supply circuit, and therefore, turning on the detector switch 36 starts to supply power from the buzzer power supply circuit to the read/verify unit 9. As a result, even if the lock driver 7 electrically fails, the read/verify unit 9 can receive power from the buzzer power supply circuit and stop the buzzer 34 on authentication of the user.

Although the present invention has been explained with reference to the embodiments, the present invention is not limited to them and allows various modifications. For example, the interlink 35 may be extended from the lock driver 7 instead of the key cylinder 25.

Although the lever 19 is pivotable around one end thereof according to the embodiments, it may be fixed if the door 3 is a sliding door.

What is claimed is:

1. A locking apparatus comprising:

a lock driver configured to electrically lock and unlock a door;

a biometric verifier configured to receive biometric information from a user, verify the received biometric information by comparing it with registered biometric information, and if the biometric verification authenticates the user, enable the lock driver to electrically operate;

a key cylinder interlinked with the lock drive to permit manual operation of the lock drive via a key cooperating with the key cylinder;

a detector configured to detect manipulation of the key cylinder;

an alarm device configured to give an alarm in response to the detector detecting manipulation of the key cylinder;

a power supply;

the detector including a switch interconnecting the alarm and the power supply which sets off the alarm when the detector detects manipulation of the key cylinder; and a normally-closed disconnecting switch connecting the power supply to the alarm, configured to disconnect the power supply when the biometric verifier authenticates the user.

2. The locking apparatus of claim 1, further comprising:

a lever configured to open and close the door;

a pivot shaft extended from the lever to face the lock driver; and a hollow formed through the pivot shaft, configured to receive the key cylinder, wherein:

an interlink is extended from the key cylinder; and an end of the interlink is joined with the lock driver when the lever with the key cylinder incorporated in the hollow is installed on the door.

3. The locking apparatus of claim 2, wherein the biometric verifier is connected to the alarm power supply circuit.

4. The locking apparatus of claim 1, wherein the biometric verifier is connected to the alarm power supply circuit.

* * * * *